US012178265B2

(12) United States Patent
Mandon et al.

(10) Patent No.: US 12,178,265 B2
(45) Date of Patent: Dec. 31, 2024

(54) BACK PROTECTION DEVICE FOR THE PRACTICE OF SPORTING ACTIVITIES

(71) Applicant: SKIS ROSSIGNOL, Saint-Jean-de-Moirans (FR)

(72) Inventors: Florence Mandon, La Murette (FR); Aurélien Soria, Voiron (FR); Thomas Morvan, Le Gua (FR)

(73) Assignee: SKIS ROSSIGNOL, Saint-Jean-de-Moirans (FR)

( * ) Notice: Subject to any disclaimer, the term of this patent is extended or adjusted under 35 U.S.C. 154(b) by 85 days.

(21) Appl. No.: 18/073,216

(22) Filed: Dec. 1, 2022

(65) Prior Publication Data

US 2023/0165320 A1 Jun. 1, 2023

(30) Foreign Application Priority Data

Dec. 1, 2021 (FR) ..... 2112812

(51) Int. Cl.
*A41D 13/05* (2006.01)
*A41D 13/015* (2006.01)

(52) U.S. Cl.
CPC ..... *A41D 13/0531* (2013.01); *A41D 13/015* (2013.01); *A41D 13/055* (2013.01); *A41D 2500/50* (2013.01); *A41D 2600/10* (2013.01)

(58) Field of Classification Search
CPC ..... A41D 13/0531; A41D 13/015; A41D 13/0156; A41D 13/05; A41D 2600/10; A41D 13/0158; A63B 71/08; A63B 71/12; A63B 71/081
USPC ..... 2/467
See application file for complete search history.

(56) References Cited

U.S. PATENT DOCUMENTS 1,254,808 A * 1/1918 Jones ..... A41D 13/04 2/467
4,516,273 A * 5/1985 Gregory ..... A63B 71/12 2/462
4,538,301 A * 9/1985 Sawatzki ..... B32B 3/10 2/455
5,465,423 A * 11/1995 Taylor-Varney ..... A41D 13/0153 2/92
6,427,695 B1 * 8/2002 Zanetti ..... A41D 13/0531 128/869

(Continued)

FOREIGN PATENT DOCUMENTS

DE 20 2006 013 732 U1 1/2007
WO 94/18861 A1 9/1994
WO 98/41118 A1 9/1998

*Primary Examiner* — Grace Huang
(74) *Attorney, Agent, or Firm* — Boone IP Law

(57) ABSTRACT

A back protection device for the practice of sporting activities includes a plate covering at least partially the surface of the back and in the thickness of which recesses are made intended to ensure the flexibility of the plate. The plate comprises a longitudinal ridge, the axis of which is intended to extend along the spine by delimiting, on either side, two right and left parts, each composed of an upper zone and a lower zone. The four zones are movable relative to each other, each being provided with recesses in the form of slots opening onto at least one face of the plate and being oriented with an inclination angle that is variable relative to the axis of the longitudinal ridge, so as to dissociate the flexibility of said zones.

20 Claims, 3 Drawing Sheets

(56) References Cited

U.S. PATENT DOCUMENTS

| | | | | |
|---|---|---|---|---|
| 6,687,920 | B2 * | 2/2004 | Berns | A41D 13/0531 2/92 |
| 6,715,218 | B2 * | 4/2004 | Johnson | A41D 13/0531 36/89 |
| 7,329,230 | B2 * | 2/2008 | Mazzarolo | A63B 71/12 2/455 |
| 7,615,023 | B2 * | 11/2009 | Nordt, III | A61F 5/0106 2/920 |
| 8,533,872 | B1 * | 9/2013 | Rodriguez | F41H 1/02 2/2.5 |
| 10,052,223 | B2 * | 8/2018 | Turner | A41B 9/06 |
| 2013/0061377 | A1 * | 3/2013 | Wyner | B32B 5/245 2/455 |
| 2013/0185853 | A1 * | 7/2013 | Ricart | A45F 3/14 224/259 |
| 2018/0180387 | A1 * | 6/2018 | Caballero | F41H 1/02 |
| 2021/0076758 | A1 * | 3/2021 | Taylor | A42B 1/08 |

* cited by examiner

BACK PROTECTION DEVICE FOR THE PRACTICE OF SPORTING ACTIVITIES

CROSS-REFERENCE TO RELATED APPLICATIONS

This application claims the benefit of priority of French Patent Application No. 2112812, filed Dec. 1, 2021, the entire content of which is hereby incorporated herein by reference, in its entirety and for all purposes.

TECHNOLOGICAL FIELD

The disclosure relates to a back protection device intended for the practice of sporting activities and, in particular, for winter sports such as skiing and snowboarding, or even sledding, as well as for any sporting activity requiring back protection, such as, for example, cycling.

BACKGROUND

Back protection devices are used to protect athletes from serious injuries affecting the dorsal part of the body and, in particular, the spine in the event of a fall or, more generally, of impacts from behind.

Generally, these protective devices exist in several sizes to adapt to different physiques (adults, children, etc.). They comprise means that make it possible both to provide the necessary flexibility so as not to hamper athletes in their movements and to ensure the absorption of energy resulting from possible impacts to the dorsal part of the body.

Body protection devices are described, in particular, in the patent application WO 94/18861 which envisages the device comprising grooves in the longitudinal and transverse direction to increase forward flexibility.

However, this device is intended for knees or elbows. This device is therefore not designed to protect the back nor, a fortiori, to allow the torsion of the upper body about the axis of the spine, nor even the inclination of one of the right or left parts of the upper body relative to the other part.

The patent application WO 98/41118 describes another device intended for the protection of any part of the body which comprises a plate provided with a series of holes connected to each other by grooves to give flexibility to this plate. But this device does not provide sufficient protection to the back since the surface of the holes weakens the structure of the device and reduces the protection.

The German utility model DE 20 2006 013 732U describes a back protection device intended, in particular, for winter sports. This device comprises transverse slots intended to facilitate the forward flexion of the body.

However, this device has no axial reinforcement and, consequently, the spine is directly exposed to impacts. Moreover, this device does not allow for dissociating between the lateral body movements, oriented to the right or to the left, nor the movements oriented from bottom to top or vice versa.

SUMMARY

In this context, the present disclosure aims to solve the technical problems posed by previous embodiments of back protection by proposing a device optimally suitable for the practice of sporting activities and in particular winter sports such as skiing and snowboarding.

In fact, it is well known that, for example, the proper handling of skis on a slope assumes that the shoulders are always facing the slope while the pelvis, and therefore the legs, are oriented in different directions depending on the trajectory followed.

However, the protective device of the disclosure may also be applied effectively in the general field of safety for other sporting activities (sledding, cycling, climbing, etc.) or professional activities in which the risk of injury and trauma to personnel are systematically present.

Thus, the back protection device of the disclosure comprises a plate, the profile of which at least partially covers the surface of the back and in the thickness of which recesses are formed, intended to ensure the flexibility of said plate. This device is characterized in that said plate includes a longitudinal ridge, the axis of which is intended to extend along the spine, delimiting, on either side, two right and left parts, each composed of a upper zone and a lower zone, the four zones being movable relative to each other, each of said zones being provided with recesses in the form of slots opening onto at least one face of said plate and being oriented with an inclination angle that is variable with respect to the axis of the longitudinal ridge so as to dissociate the flexibility of said zones.

Because the practice of sporting activities involves great mobility of different parts of the body and, in particular, flexion and/or torsion movements of the body, the back protection device of the disclosure aims to dissociate them by being composed of four symmetrical parts, two by two, respectively, right, left, lower and upper.

According to an advantageous feature of the disclosure, in the upper zones of the protective device, the slots are oriented divergently relative to the axis of the longitudinal ridge towards the upper edge of the plate, and, in the lower zones, the slots are oriented divergently relative to said axis towards the lower edge of the plate.

According to an advantageous feature, the longitudinal ridge has a central block located at the intersection of the four zones.

According to another feature, the slots start close to the axis of the longitudinal ridge and extend as far as the contours of the plate, leaving a solid peripheral edge.

According to yet another feature of the disclosure, the slots open onto the outer face of the plate.

According to a variant of the disclosure, it is provided that at least one slot of each right and left part also opens onto the inner face of the plate via at least one opening made through the bottom of said slot.

According to other features of the disclosure, the inclination angle of the slots with respect to the axis of the longitudinal ridge is between 0° and 180° in absolute value and, preferably, in said upper zones, the inclination angle of the slots is between 10° and 90°; whereas, in said lower zones, the inclination angle of the slots is between 90° and 180°.

According to specific variant embodiments of the protection device of the disclosure, the distal portions of the upper and lower zones have a series of parallel slots.

Moreover, according to one of these variants, the two upper zones, right and left, respectively, are separated from the two lower zones, right and left, respectively, by at least one slot extending along an axis perpendicular to the axis of the longitudinal ridge.

According to an advantageous feature of the disclosure, the variation, between two adjacent slots, of their inclination angle relative to the axis of the longitudinal ridge is between 0° and 6°.

Other features of the disclosure relate to the fact that the two right and left parts are symmetrical.

Furthermore, provision is made for the upper zones, right and left, to have dimensions that make it possible to cover, at least in part, the shoulder blades.

At the same time, the disclosure provides for the two lower zones, right and left, to have dimensions that make it possible to cover, at least in part, the lumbar vertebrae.

Preferably, the plate is made with an elastic or viscoelastic material.

According to yet another variant embodiment of the device of the disclosure, the plate is provided with elements for attaching a support and holding strap.

Another subject of the disclosure is a use of the device as defined above, characterized in that the plate is housed in a back pocket of a vest.

The device of the disclosure provides very effective back protection, in particular with regard to the shoulder blades, the vertebrae, and the spine.

Moreover, due to specific and different orientations of the slots in the upper zones and the lower zones of the plate, respectively, the protection device of the disclosure offers optimum flexibility for the practice of sporting activities, such as winter sports, by facilitating, in a dissociated way, the torsional mobility of the shoulders and that of the pelvis around the central part of the plate.

BRIEF DESCRIPTION OF THE FIGURES

Other features and advantages of the disclosure will emerge on reading the following disclosure, with reference to the appended figures and detailed hereinafter.

For greater clarity, identical or similar elements are identified by identical reference signs in all of the figures.

Naturally, the embodiment of the disclosure illustrated in the figures shown above is only given by way of non-limiting example. It is explicitly provided that it may be implemented in different variants without departing from the scope of the disclosure.

DETAILED DESCRIPTION

The disclosure relates to the back protection of persons in the context of sporting activities such as winter sports and, in particular, downhill skiing, cross-country skiing, "freeriding" or snowboarding, sledding, and even cycling.

In certain sporting activities, the protection of the back and, in particular, the spine, is particularly important, even necessary. This is the case in particular for the practice of skiing or cycling in which falls on the back or impacts from behind are quite frequent.

The object of the disclosure is to provide an improvement to existing back protection devices. Traditionally, protective devices generally comprise a plate 1 covering at least partially the surface of the back and in the thickness of which recesses are formed intended to ensure the flexibility of this plate to adapt it to the physique of the user, allowing the user to perform different body movements.

Figure 1:
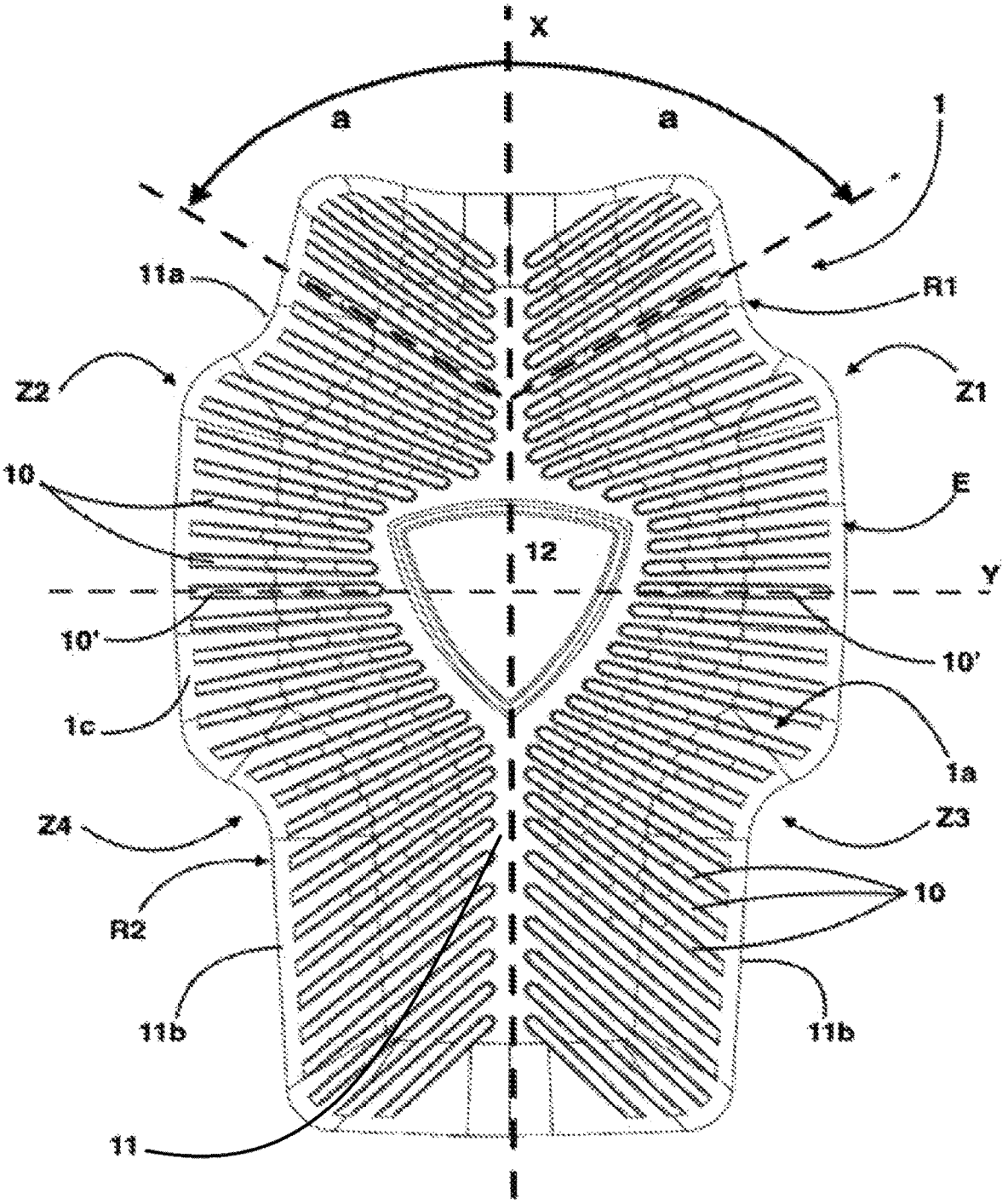
FIG. 1 is a view of the outer face of a preferred embodiment of the back protection device of the disclosure.
Figure 2:
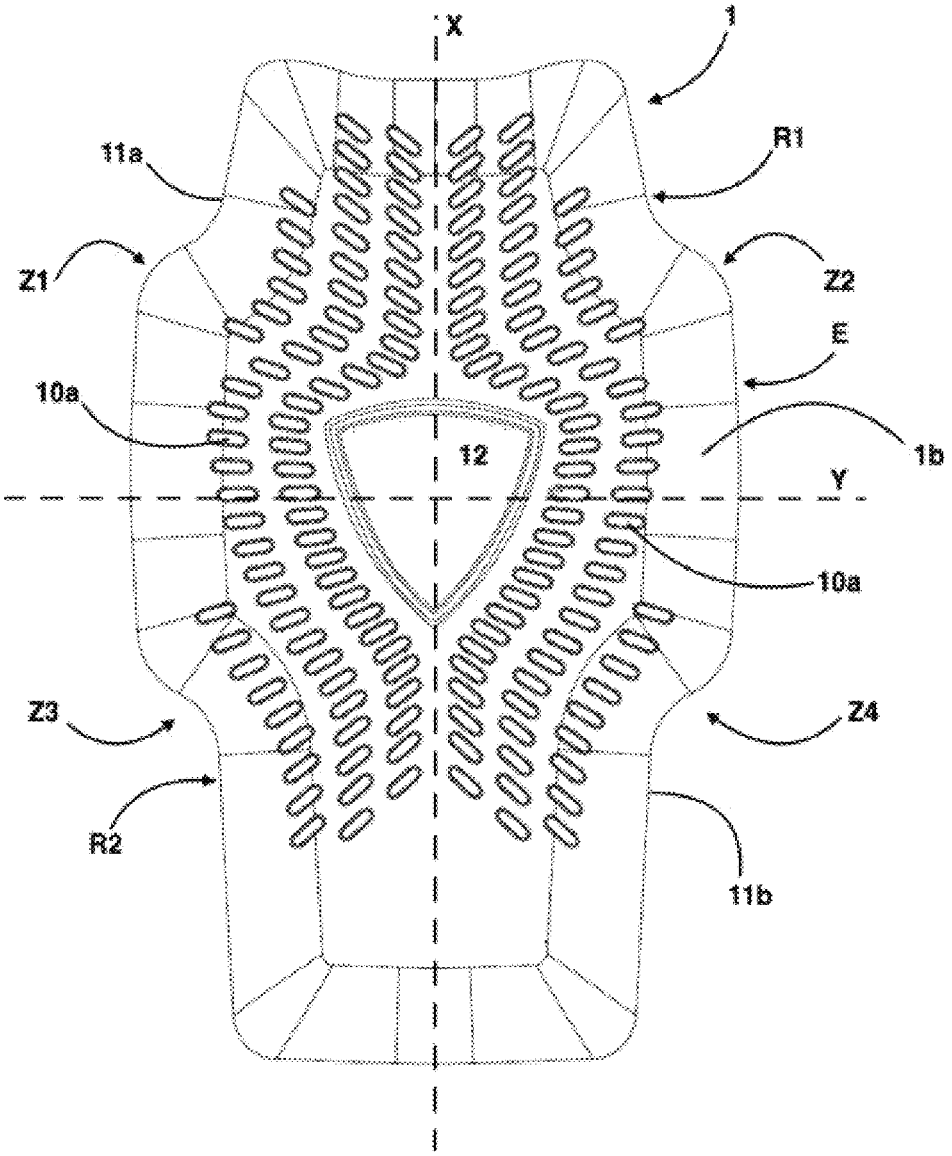
FIG. 2 is a view of the inner face of the back protection device of FIG. 1.

The protection device of the disclosure of the disclosure is characterized in that the plate 1 comprises a longitudinal ridge 11, the axis X of which is intended to extend along the spine (see FIGS. 1 and 3) delimiting, on either side, four zones, two right and left parts, preferably symmetrical, each composed of an upper zone, right Z1 and left Z2 (in rear views), respectively, and of a lower zone, right Z3 and left Z4, respectively, as shown in FIGS. 1 and 2.

The plate 1 according to the disclosure is preferably made with an elastic or viscoelastic material, for example an elastomer, or even a polymer, optionally based on silicone. The material is chosen in such a way as to be very flexible at rest, while hardening on impact to ensure the protection of the user's back. In particular, a polymer containing a shear-thickening fluid is suitable.

The disclosure provides for these zones to be movable, or at least deformable under stress, in relation to each other by being provided with recesses grouped together in the form of bundles of slots 10, 10'. These bundles of slots are in particular divergent with respect to the longitudinal axis X. These slots open at least on the outer face 1*a* of the plate 1 and are oriented with an inclination angle a that is variable with respect to the axis X of the longitudinal ridge 11. This substantially "fishbone" configuration makes it possible to dissociate the intrinsic flexibility of the zones Z1, Z2, Z3 and Z4 and their relative mobility in several directions and thus to improve the freedom of movement of the user, in particular, in torsion, as described hereinafter.

Each slot 10 preferably has a continuous rectilinear profile, but it will not depart from the scope of the disclosure if the recesses are made up of a succession of small slots aligned, longitudinally and discontinuously, one after the other. Preferably, the width of a slot is constant but it will not depart from the scope of the disclosure if this width changes slightly over the length of the slot.

Figure 4:
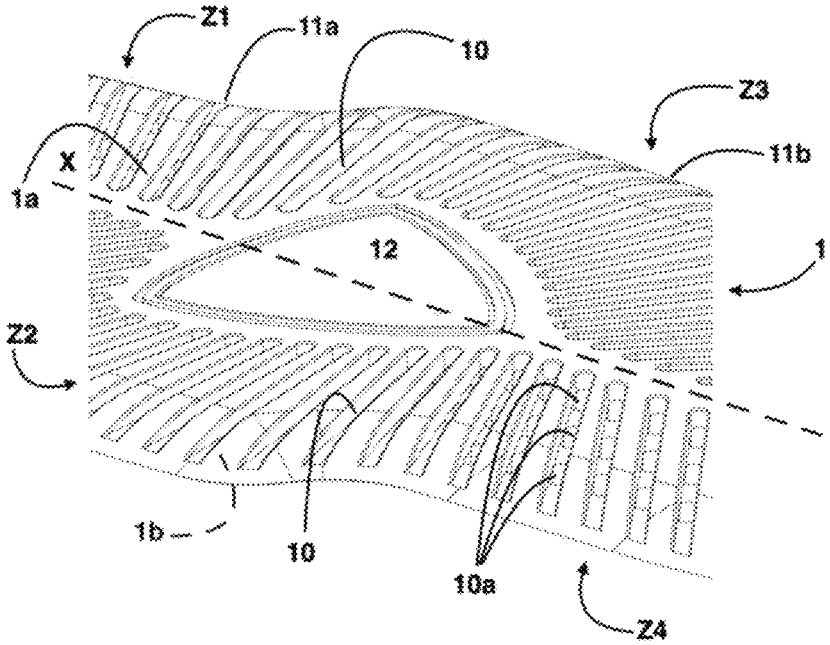
FIG. 4 is a perspective detail view of the outer face of the back protection device of FIG. 1.

As illustrated by FIG. 4, the two upper zones, right Z1 and left Z2, have profiles and dimensions making it possible to cover, at least partially, the shoulder blades, while the two lower zones, right Z3 and left Z4, have profiles and dimensions making it possible to cover the shoulder blades with their upper part and at least partially, the lumbar vertebrae with their lower part.

In the free state, i.e., in the undeformed state and at rest, the profile of the plate 1 is flat, and its flexibility is chosen to allow it to fit the shape of the back when it is worn by a user. In other words, the plate 1 has a protrusion E extending transversely in the middle zone and which is extended, respectively, upwards and downwards by two narrowings R1, R2 (FIGS. 1 and 2). This protrusion E is intended to protect, in particular, the shoulder blades of the user.

The longitudinal ridge 11 is rigid in the sense that it has a greater rigidity than the rigidity of the parts of the device comprising slots. This ridge, however, allows in particular the forward flexion of the device. It is preferably not perforated; however, small openings may be envisaged if its overall rigidity remains sufficient.

This longitudinal ridge 11 comprises in particular a central block 12 located at the intersection of the four zones Z1 to Z4. This block, which is also rigid, forms the central fixed point of the articulation of the flexible zones Z1 to Z4. The outer face of the block 12 may, if necessary, carry functional elements (electronics such as a photoelectric cell, LEDs, etc.) or mechanical elements (hooks, loops, etc.) or even display information (trademark, etc.). This central block 12 may be polygonal or circular, or even oval.

The slots 10, which are bundled on the zones Z1, Z2, Z3 and Z4 of the outer face 1*a*, extend from the proximity of the longitudinal ridge 11 to the contours of the plate 1, leaving a solid peripheral edge 1*c*. This border has a width which is preferably uniform over the entire perimeter of the outer face 1*a* of the plate 1 as illustrated in FIG. 1.

The distal parts of each zone, (i.e., those which are at the upper ends of the zones Z1 and Z2 and at the lower ends of the lower zones Z3 and Z4), comprise slots 10 which only open onto the outer face 1*a* of plate 1.

On the other hand, the proximal parts of each zone located in the middle part of the plate 1, (i.e., those which are in the lower parts of the zones Z1 and Z2 and which are adjacent to the upper parts of the zones Z3 and Z4), comprise at least one slot which also opens onto the inner face 1*b* of the plate 1 via at least one opening 10*a* provided through the bottom. The openings 10*a* allow ventilation of the space located between the back of the user and the inner face 1*b* of the plate 1, as well as the optimization of the flexibility of the zones of the device.

These openings 10*a* have a length much less than the total length of the slot in which they are made. Their width is substantially the same as that of a slot. These openings 10*a* are short in length and limited in number so as not to weaken the resistance of the plate and not to alter the protection of the user's back in order to meet the safety standards in force. These openings 10*a* may be, for example, of circular or oblong shape.

Figure 3:
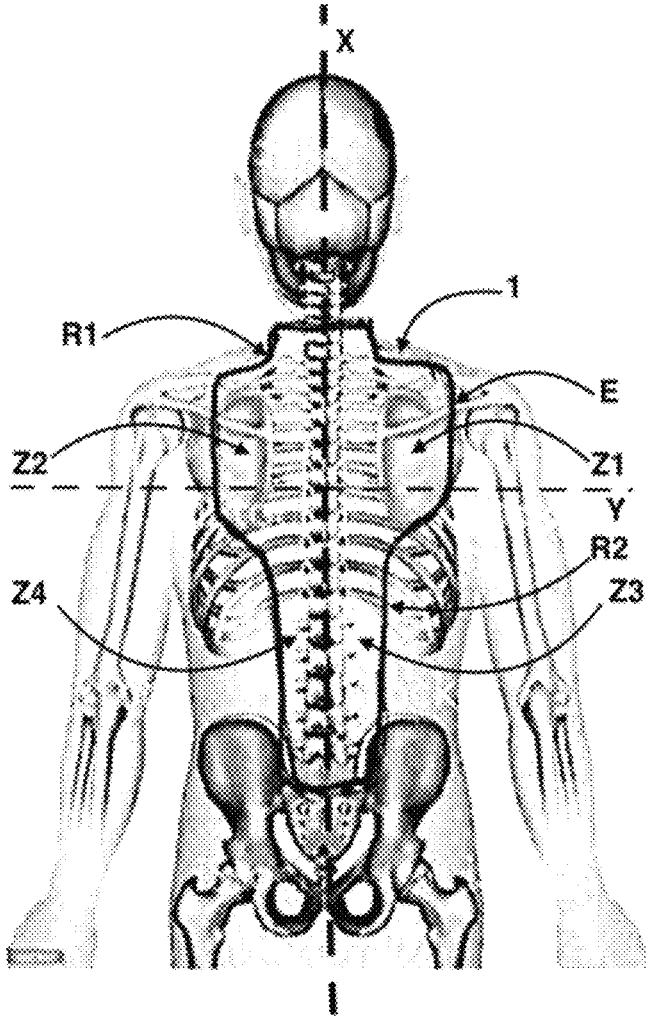
FIG. 3 is a partial rear view of the device of FIG. 1 in the dorsal position on an athlete.

In the embodiment of the disclosure illustrated in FIGS. 1, 2 and 3, the through slots have two or three openings 10*a*. However, without departing from the scope of the disclosure, it is possible to provide variant embodiments in which the slots would comprise more than three openings, located in possibly different slots, depending, in particular, on the degrees of ventilation and flexibility desired.

In the embodiment of the disclosure illustrated here in FIGS. 1 and 2, the plate 1 comprises, in the distal part of the lower zones Z3, Z4, five slots which only open onto the outer face 1*a* while the other thirty open onto the two faces 1*a*, 1*b*.

The thickness of the plate 1 being approximately 10 mm, the slots 10 have a depth of approximately 5 mm and the openings 10*a* also have a height of 5 mm. The slots have a U-shaped cross-section and their width is about 5 mm. The plate is made in different formats depending on the users (adults or children). In the case of the plate 1 adapted for children, the lower narrowing R2 of the plate 1 is shorter and may not extend to the lumbar region of the user. For an adult, the maximum width of the protrusion E of the plate 1 is between 200 mm and 260 mm. The width of the narrowings R1, R2 is between 130 mm and 160 mm.

Broadly, in each of the four zones, the slots diverge from the axis X in specific directions. In the upper zones Z1, Z2, the slots are oriented in a divergent manner with respect to the axis X towards the upper edge 11*a* of the plate 1, and in the lower zones Z3, Z4, the slots are oriented in a divergent manner with respect to the axis X towards the lower edge 11*b* of the plate, as shown in FIGS. 1 and 4.

The slots are inclined with respect to the axis X of the longitudinal ridge 11 with an angle a between 0° and 180° in absolute value and, more precisely, between 20° and 160° in absolute value, preferably between 40° and 120° in absolute value. For the upper parts of the plate 1, the angle a varies from 0° to 90°, preferably between 40° and 90°, while for the lower parts, the angle a varies between 90° and 180° and, preferably between 90° and 140°. In the right parts, the angle a is counted clockwise, while in the left parts, the angle a is counted counterclockwise, as shown by the arrows in FIG. 1.

More particularly, the plate 1 has on at least one part of this plate 1, an axial symmetry with respect to the axis X, i.e., the slots of the left part are symmetrical with the slots of the right part.

Preferably, the distal parts of the zones Z1, Z2, Z3 and Z4 comprise a series of slots which are parallel to each other and inclined with respect to the axis X of the longitudinal ridge 11 with an angle a of approximately 45°.

The two upper zones, right Z1 and left Z2, respectively, are physically separated from the two lower zones, right Z3 and left Z4, respectively, by at least one slot 10' extending along an axis Y perpendicular to the axis X of the longitudinal ridge 11 from the central block 12. Thus, this slot 10' is inclined at an angle equal to 90° with respect to the axis X.

However, it is provided according to the disclosure for the inclination of the slots 10 to be variable according to their position on the plate 1. In fact, as shown in FIGS. 1 and 2, the variation between two adjacent slots of the inclination angle a with respect to the axis X of the longitudinal ridge 11 is either constant or changing. For example, this variation is between 0° and 6° and, preferably, between 2° and 5°.

As illustrated by FIGS. 1 and 2, in each zone Z1 to Z4, the longest slots are at the level of the protrusion E in the enlarged middle parts located around the central block 12, while the shortest slots are located at their distal parts and, more particularly, in the narrowings R1, R2 of the distal parts of the upper zones Z1, Z2 which are narrower, to take account of the shape of the back.

More precisely, the specific orientation of the slots 10 in each zone makes it possible to optimize the local deformations of the plate 1 to facilitate different bodily movements of the user. Thus, the slots located in the upper zones Z1, Z2, jointly favor the mobility of the user's shoulders induced by the rotation of the chest about the vertical axis X, as well as forward flexion about the axis Y. The slots located in the lower zones Z3, Z4 jointly favor the mobility of the lower back induced by the rotation of the pelvis about the axis X as well as the forward flexion about the axis Y. This dissociation of the movements of the back, in particular of the shoulders with respect to the pelvis, allows great freedom of movement for the motions of athletes, which is particularly favorable in skiing, sledding, and cycling.

Thus, the dissociated deformations of the four zones of the plate created by the specific orientations of the slots in each of the zones makes it possible to favor all the decoupled movements of the athlete's body, in particular, the right-left decoupling and the upper/lower decoupling to favor movements about the axis X, about the axis Y, and the combined movements about any axis located in the plane XY.

Where appropriate, according to a variant embodiment of the protection device of the disclosure, the plate 1 is provided with attachment elements intended to ensure the connection with at least one support and holding strap (not shown), to position and hold the plate 1 on the user's back.

Another use of the protection device of the disclosure consists in housing the plate 1 in a suitable back pocket, attached to or integral with a vest, jacket, or suit worn by the user. In this case, the plate 1 is preferably removable.

The invention claimed is:

1. A back protection device for sporting activities, comprising:

a plate configured to cover at least partially a surface of the back, wherein said plate comprises a longitudinal ridge, an axis X of the longitudinal ridge being configured, when the back protection device is worn on the back, to extend along a spine of the back, the axis X extending in a positive X direction toward an upper portion of the back and in a negative X direction toward a lower portion of the back, wherein the longitudinal ridge delimits, on either side of the longitudinal ridge, two right and left parts each composed of an upper zone and a lower zone, thus forming four distinct zones, the four zones being movable relative to each other, each of said zones being provided with a plurality of recesses in the form of a plurality of slots opening onto at least one face of said plate, the recesses being formed in the thickness of the plate and being configured to ensure a flexibility of said plate, the slots being oriented with an inclination angle that varies with respect to the axis X of the longitudinal ridge so as to dissociate a flexibility of said zones, wherein, in each of said zones, the slots are distributed in a series of the slots and are grouped together in one or more bundles of the slots, the slots of the one or more bundles being divergent with respect to the axis X of the longitudinal ridge, wherein the slots open onto an outer face of the at least one face of the plate, wherein at least one slot of each right and left part also opens onto an inner face of the at least one face of the plate via at least one opening formed through a bottom of said slot, wherein the inclination angle of the slots with respect to the axis X of the longitudinal ridge is between 0° and 180° in absolute value, and wherein, in said upper zones, the inclination angle of the slots is between 0° and 90°, while in said lower zones, the inclination angle of the slots is between 90° and 180°.

2. The device according to claim 1, wherein, in the upper zones of the right and left parts, the slots are oriented divergently with respect to the axis X towards an upper edge of the plate and, in the lower zones of the right and left parts, the slots are oriented divergently with respect to the axis X towards a lower edge of said plate.

3. The device according to claim 1, wherein the longitudinal ridge comprises a central block located at an intersection of the four zones.

4. The device according to claim 1, wherein said slots start close to the axis X and extend as far as contours of said plate, leaving a full peripheral edge.

5. The device according to claim 1, wherein distal parts of the upper and lower zones comprise a series of parallel slots.

6. The device according to claim 1, wherein the two upper zones, right and left, respectively, are separated from the two lower zones, right and left, respectively, by at least one slot extending along an axis Y perpendicular to the axis X of the longitudinal ridge.

7. The device according to claim 1, wherein a variation between two adjacent slots of their inclination angle with respect to the axis X of the longitudinal ridge is between 0° and 6°.

8. The device according to claim 1, wherein the two upper zones, right and left, have dimensions configured to cover shoulder blades at least in part.

9. The device according to claim 1, wherein the two lower zones, right and left, have dimensions configured to cover at least lumbar vertebrae.

10. The device according to claim 1, wherein said plate is made with an elastic or viscoelastic material.

11. The device according to claim 1, wherein the left and right parts of said plate are symmetrical with respect to the axis X.

12. The device according to claim 1, wherein said plate is provided with elements configured for attaching at least one support and holding strap.

13. A method of using the device according to claim 1, wherein said plate is housed in a back pocket of a vest.

14. The device according to claim 1, wherein the plurality of slots open onto the inner face of the at least one face of the plate via respective openings formed through a bottom of said plurality of slots.

15. A back protection device for sporting activities, comprising:

a plate configured to cover at least partially a surface of the back, wherein said plate comprises a longitudinal ridge, an axis X of the longitudinal ridge being configured, when the back protection device is worn on the back, to extend along a spine of the back, the axis X extending in a positive X direction toward an upper portion of the back and in a negative X direction toward a lower portion of the back, wherein the longitudinal ridge delimits, on either side of the longitudinal ridge, two right and left parts each composed of an upper zone and a lower zone, thus forming four distinct zones, the four zones being movable relative to each other, each of said zones being provided with a plurality of recesses in the form of a plurality of slots opening onto at least one face of said plate, the recesses being formed in the thickness of the plate and being configured to ensure a flexibility of said plate, the slots being oriented with an inclination angle that varies with respect to the axis X of the longitudinal ridge so as to dissociate a flexibility of said zones, and wherein the longitudinal ridge is free of the slots and has a greater rigidity than a rigidity of the two right and left parts of the device comprising the slots.

16. A back protection device for sporting activities, comprising:

a plate configured to cover at least partially a surface of the back, wherein said plate comprises a longitudinal ridge, an axis X of the longitudinal ridge being configured, when the back protection device is worn on the back, to extend along a spine of the back, the axis X extending in a positive X direction toward an upper portion of the back and in a negative X direction toward a lower portion of the back, wherein the longitudinal ridge delimits, on either side of the longitudinal ridge, two right and left parts each composed of an upper zone and a lower zone, thus forming four distinct zones, the four zones being movable relative to each other, each of said zones being provided with a plurality of recesses in the form of a plurality of slots opening onto at least one face of said plate, the recesses being formed in the thickness of the plate and being configured to ensure a flexibility of said plate, the slots being oriented with an inclination angle that varies with respect to the axis X of the longitudinal ridge so as to dissociate a flexibility of said zones, wherein the left and the right upper zones respectively include at least a plurality of first and second slots of the plurality of slots, wherein first endpoints of all the first slots are colinear along the positive X direction, wherein second endpoints of all the second slots are colinear along the positive X direction, the first and second slots each being acutely angled relative to the positive X direction, and wherein the left and right lower zones respectively include at least a plurality of third and fourth slots of the plurality of slots, wherein third endpoints of all the third slots are colinear along the negative X direction, wherein fourth endpoints of all the fourth slots are colinear along the negative X direction, the third and fourth slots being acutely angled relative to the negative X direction.

17. The device according to claim 16, wherein distal parts of the upper and lower zones comprise a series of parallel slots.

18. The device according to claim 16, wherein the two upper zones, right and left, respectively, are separated from the two lower zones, right and left, respectively, by at least one slot extending along an axis Y perpendicular to the axis X of the longitudinal ridge.

19. The device according to claim 16, wherein a variation between two adjacent slots of their inclination angle with respect to the axis X of the longitudinal ridge is between 0° and 6°.

20. The device according to claim 16, wherein said plate is made with an elastic or viscoelastic material.

* * * * *